US010864719B2

(12) United States Patent
Cumbie et al.

(10) Patent No.: US 10,864,719 B2
(45) Date of Patent: Dec. 15, 2020

(54) FLUID EJECTION DEVICE INCLUDING INTEGRATED CIRCUIT

(71) Applicant: Hewlett-Packard Development Company, L.P., Houston, TX (US)

(72) Inventors: Michael W. Cumbie, Corvallis, OR (US); Chien-Hua Chen, Corvallis, OR (US); Anthony M. Fuller, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 99 days.

(21) Appl. No.: 15/772,416

(22) PCT Filed: Feb. 24, 2016

(86) PCT No.: PCT/US2016/019389
§ 371 (c)(1),
(2) Date: Apr. 30, 2018

(87) PCT Pub. No.: WO2017/146699
PCT Pub. Date: Aug. 31, 2017

(65) Prior Publication Data

US 2018/0319160 A1 Nov. 8, 2018

(51) Int. Cl.
*B41J 2/045* (2006.01)
*B41J 2/14* (2006.01)
(Continued)

(52) U.S. Cl.
CPC ..... *B41J 2/04541* (2013.01); *B41J 2/14072* (2013.01); *B41J 2/14145* (2013.01);
(Continued)

(58) Field of Classification Search
CPC .. B41J 2/1404; B41J 2/14072; B41J 2/14145; B41J 2/1603; B41J 2/1632; B41J 2/1637;
(Continued)

(56) References Cited

U.S. PATENT DOCUMENTS

2002/0067384 A1 6/2002 Anderson et al.
2002/0126128 A1 9/2002 Tsurube et al.
(Continued)

FOREIGN PATENT DOCUMENTS

CN 102036825 4/2011
CN 105142909 12/2015
(Continued)

OTHER PUBLICATIONS

Marinis, Dr. Thomas F., "The Future of MEMS", Retrieved on Dec. 31, 2015, 24 pages.

*Primary Examiner* — Henok D Legesse
(74) *Attorney, Agent, or Firm* — Middleton Reutlinger

(57) ABSTRACT

Examples include a fluid ejection device comprising a molded panel, an ejection die molded in the molded panel, and an integrated circuit molded in the molded panel. The ejection die comprises ejection nozzles to selectively dispense printing material. The integrated circuit receives nozzle data and controls the selective dispensation of printing material by the ejection nozzles based at least in part on the nozzle data. The molded panel has a fluid communication channel formed therethrough and fluidly connected to the ejection die.

14 Claims, 12 Drawing Sheets

(51) Int. Cl.
*B41J 2/16* (2006.01)
*B41J 2/175* (2006.01)

(52) U.S. Cl.
CPC ..... *B41J 2/1603* (2013.01); *B41J 2/1753* (2013.01); *B41J 2/17553* (2013.01); *B41J 2/04536* (2013.01); *B41J 2/1632* (2013.01); *B41J 2/1637* (2013.01)

(58) Field of Classification Search
CPC .. B41J 2/1753; B41J 2/17553; B41J 2/04536; B41J 2/04541; B41J 2/1433
See application file for complete search history.

(56) References Cited

U.S. PATENT DOCUMENTS

| | | | |
|---|---|---|---|
| 2002/0126168 | A1 | 9/2002 | Anderson et al. |
| 2011/0037808 | A1 | 2/2011 | Ciminelli et al. |
| 2011/0115852 | A1 | 5/2011 | Bibl et al. |
| 2012/0186079 | A1 | 7/2012 | Ciminelli |
| 2014/0055528 | A1 | 2/2014 | Bibl et al. |
| 2014/0375730 | A1 | 12/2014 | Campbell-Brown et al. |
| 2016/0001558 | A1 | 1/2016 | Chen et al. |

FOREIGN PATENT DOCUMENTS

| | | | |
|---|---|---|---|
| CN | 108136415 | | 6/2018 |
| JP | 09131896 | | 5/1997 |
| JP | 11192705 | | 7/1999 |
| JP | 2003260696 | | 9/2003 |
| JP | 2007320278 | | 12/2007 |
| JP | 2012532037 | | 12/2012 |
| TW | I467657 | | 1/2015 |
| WO | WO-03018314 | | 3/2003 |
| WO | WO-2012044299 | | 4/2012 |
| WO | WO-2013085543 | | 6/2013 |
| WO | WO-2014133576 | | 9/2014 |
| WO | WO-2014133590 | | 9/2014 |
| WO | WO2014133590 | A1 * | 9/2014 |
| WO | WO-2014133600 | | 9/2014 |
| WO | WO-2014133633 | | 9/2014 |
| WO | WO-2014209506 | | 12/2014 |
| WO | WO-2015041665 | | 3/2015 |
| WO | WO-2015116073 | | 8/2015 |
| WO | WO-2015183296 | | 12/2015 |

* cited by examiner

FLUID EJECTION DEVICE INCLUDING INTEGRATED CIRCUIT

BACKGROUND

Printers are devices that deposit a fluid, such as ink, on a print medium, such as paper. A printer may include a printhead that is connected to a printing material reservoir. The printing material may be expelled, dispensed, and/or ejected from the printhead onto a physical medium.

DRAWINGS

Throughout the drawings, identical reference numbers designate similar, but not necessarily identical, elements. The figures are not necessarily to scale, and the size of some parts may be exaggerated to more dearly illustrate the example shown.

DESCRIPTION

Figure 1:
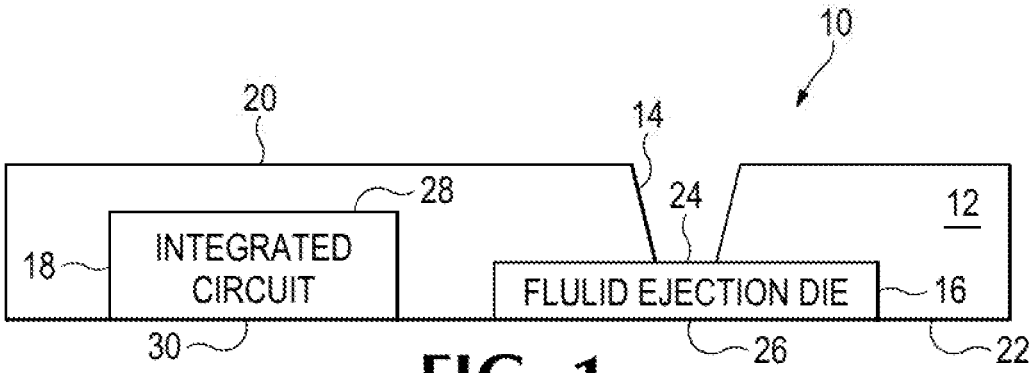
FIG. 1 is a block diagram that illustrates some components of an example fluid ejection device.

Examples of fluid ejection devices may comprise a molded panel, at least one ejection die, and an integrated circuit. The ejection die and integrated circuit are molded into the molded panel. As used herein, molded in to the molded panel may refer to the ejection die and/or integrated circuit being at least partially embedded in the molded panel. The ejection die comprises a plurality of ejection nozzles, where the ejection nozzles may be used to selectively dispense printing material. The integrated circuit may be electrically connected to the ejection die, and the integrated circuit may control the selective dispensation of printing material with the ejection nozzles. The molded panel supports and at least partially surrounds the ejection die and the integrated circuit such that the ejection die and the integrated circuit are at least partially covered by mold material of the molded panel. Furthermore, the molded panel may have a fluid communication channel that is formed through the molded panel. The fluid communication channel of the molded panel is fluidly connected to the ejection die, such that printing material may be conveyed to the ejection die and the ejection nozzles thereof via the fluid communication channel.

Ejection nozzles eject/dispense printing material under the control of the integrated circuit to form printed content with the printing material on a physical medium. Nozzles generally include fluid ejectors to cause printing material to be ejected/dispensed from a nozzle orifice. Some examples of types of fluid ejectors implemented in fluid ejection devices include thermal ejectors, piezoelectric ejectors, and/or other such ejectors that may cause printing material to eject/be dispensed from a nozzle orifice. In some examples the ejection dies may be formed with silicon or a silicon-based material. Various features, such as nozzles, may be formed from various materials used in silicon device based fabrication, such as silicon dioxide, silicon nitride, metals, epoxy, polyimide, other carbon-based materials, etc.

In some examples, ejection dies may be referred to as slivers. Generally, a sliver may correspond to an ejection die having: a thickness of approximately 650 μm or less; exterior dimensions of approximately 30 mm or less; and/or a length to width ratio of approximately 3 to 1 or larger. In some examples, a length to width ratio of a sliver may be approximately 10 to 1 or larger. In some examples, a length to width ratio of a sliver may be approximately 50 to 1 or larger. In some examples, ejection dies may be a non-rectangular shape. In these examples a first portion of the ejection die may have dimensions/features approximating the examples described above, and a second portion of the ejection die may be greater in width and less in length than the first portion. In some examples, a width of the second portion may be approximately 2 times the size of the width of the first portion. In these examples, an ejection die may have an elongate first portion along which ejection nozzles may be arranged, and the ejection die may have a second portion upon which electrical connection points for the ejection die may be arranged.

In some examples, the molded panel may comprise an epoxy mold compound, such as CEL400ZHF40WG from Hitachi Chemical, Inc., and/or other such materials. Accordingly, in some examples, the molded panel may be substantially uniform. In some examples, the molded panel may be formed of a single piece, such that the molded panel may comprise a mold material without joints or seams. In some examples, the molded panel may be monolithic.

Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

In some examples, a printing device in which a fluid ejection device may be implemented may print content by deposition of consumable fluids in a layer-wise additive manufacturing process. Consumable fluids and/or consumable materials may include all materials and/or compounds used, including, for example, ink, toner, fluids or powders, or other raw material for printing. Furthermore, printing material, as described herein may comprise consumable fluids as well as other consumable materials. Printing material may comprise ink, toner, fluids, powders, colorants, varnishes, finishes, gloss enhancers, binders, and/or other such materials that may be utilized in a printing process.

Turning now to the figures, and particularly to FIG. 1, this figure provides a block diagram that illustrates some components of an example fluid ejection device 10. In this example, the fluid ejection device 10 comprises a molded panel 12. The molded panel 12 has a fluid communication channel 14 formed therethrough. In addition, the fluid ejection device 10 comprises a fluid ejection die 16 and an integrated circuit 18 molded in the molded panel. In this example, the molded panel has a first surface 20 (which may be referred to as a back surface) and a second surface 22 (which may be referred to as a front surface) that is opposite the first surface 20. Similarly, the ejection die 16 has a first surface 24 and a second surface 26, and the integrated circuit 18 has a first surface 28 and a second surface 30.

As shown, the fluid communication channel 14 is formed in the first surface 20 of the molded panel 12. The surfaces defining the fluid communication channel 14 facilitate fluid communication with the ejection die 16. In particular, a portion of the second surface 24 of the ejection die 16 is exposed to the fluid communication channel 14. While not shown in this example, the ejection die 16 may comprise fluid feed holes formed therethrough that fluidly connect the fluid communication channel 14 with ejection nozzles of the ejection die 16. Orifices of the ejection nozzles of the ejection die 16 may be formed on the second surface 26 of the ejection die 16. As shown in this example, the second surface 22 of the molded panel 12, the second surface 26 of the ejection die 26, and the second surface of the integrated circuit 30 may be approximately coplanar.

Accordingly, in examples similar to the example of FIG. 1, the ejection die 16 and the integrated circuit 18 may be molded into the molded panel 12. As shown, the ejection die 16 and integrated circuit 18 are at least partially embedded in the molded panel such that the ejection die 16 and integrated circuit are joined to the molded panel 12. For example, referring to the ejection die 16, the first surface 24 and the sides of the ejection die are at least partially covered by the molded panel 12. The second surface 26 of the ejection die 16, from which ejection nozzles may dispense printing material, may be exposed and approximately coplanar with the second surface of the molded panel 12. Similarly, for the integrated circuit 18, the first surface 28 and sides may be covered by the molded panel 12. The second surface 30 of the integrated circuit 18 may be exposed and approximately planar with the second surface 22 of the molded panel 12. As will be appreciated, by molding the ejection die 16 and integrated circuit 18 into the molded panel 12, the ejection die 16 and integrated circuit 18 may be coupled to the molded panel without adhesive therebetween. In such examples, where the ejection die 16 and the integrated circuit 18 are at least partially covered by material of the molded panel, the ejection die 16 and the integrated circuit may be described as at least partially embedded in the molded panel 12.

Figure 2:
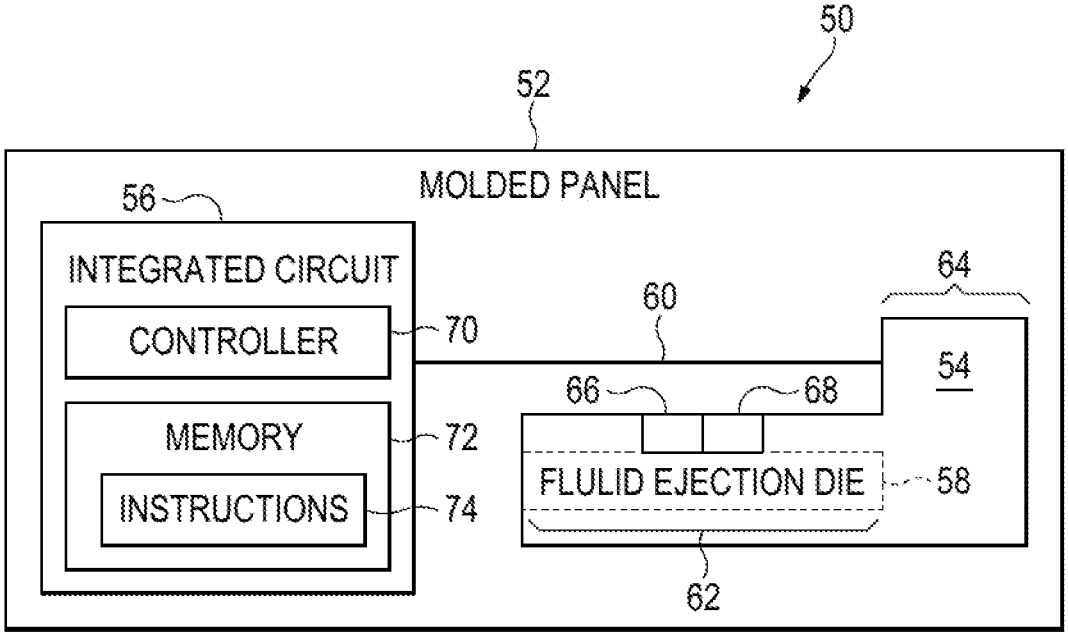
FIG. 2 is a block diagram that illustrates some components of an example fluid ejection device.

Turning now to FIG. 2, this figure provides a block diagram that illustrates some components of an example fluid ejection device 50. In this example, the fluid ejection device 50 comprises a molded panel 52 into which an ejection die 54 and an integrated circuit 56 may be molded. In this example, the molded panel 52 may have a fluid communication channel 58 that is formed therethrough. As will be appreciated, the fluid communication channel 58 is illustrated in dashed line to illustrate that the fluid communication channel 58 is formed on a back surface of the molded panel 52, while the front surface of the molded panel is approximately planar with a front surface of the ejection die 54 and a front surface of the integrated circuit 56.

In this example, the ejection die 54 is electrically connected to the integrated circuit 56 via at least one electrical conducting element 60. In some examples, the at least one electrical conducting element 60 may comprise traces formed from a conductive material (e.g., copper based material, gold based material, silver based material, aluminum based materials, conductive polymers, etc.). In some examples, the at least one electrical conducting element 60 may be positioned on a front surface of the example fluid ejection device 50. In some examples, the at least one electrical conducting element 60 may be included in an insulating material. For example, the at least one electrical conducting element 60 may include an insulated film such as a polyamide film or a polyimide film. In such examples, the at least one electrical conducting element may be coupled to the molded panel 52 to electrically connect the ejection die 54 and the integrated circuit 56 via a tape automated bonding (TAB) process. In other examples, a portion of the at least one electrical conducting element 60 may be at least partially embedded in the molded panel 52. In some examples, the at least one electrical conducting element 60 may be coupled to the ejection die 54 and the integrated circuit in a wire bonding process.

As shown in the example of FIG. 2, the ejection die 54 may be a non-rectangular die. In such examples, the ejection die 54 may comprise an elongated first portion 62 and a second portion 64. Ejection nozzles of the ejection die 54 may be arranged along the length of the elongated first portion 62, and electrical contact points of the ejection die 54 may be arranged in the second portion 64. Accordingly, as shown, the at least one electrical conducting element 60 may be connected to the ejection die 54 at the second portion 64. Moreover, the integrated circuit 56 may be positioned proximate the ejection die 54 at a first end of the ejection die 54, and the second portion 64 is positioned at second end of the ejection die 54 that is opposite the first end.

In addition, in this example, the ejection die 54 may comprise at least one temperature sensor 66. In such examples, the integrated circuit 56 may receive sensor data from the at least one temperature sensor 66. Based at least in part on the sensor data, the integrated circuit 56 may determine a temperature associated with the ejection die 54. For example, the at least one temperature sensor 66 may comprise a resistive element. A resistance of the resistive element may change based on temperature. In such examples, the integrated circuit 56 may actuate the temperature sensor and receive sensor data that corresponds to a resistance of the resistive element, and the integrated circuit 56 may determine a temperature associated with the ejection die 54 based on the sensor data.

Furthermore, the ejection die 54 may comprise at least one heating element 68. In such examples, the integrated circuit 56 may control the at least one heating element 68. In some examples, the integrated circuit 56 may control the at least one heating element 68 based at least in part on sensor data received from the at least one temperature sensor 66. In some examples, the ejection die may have a defined operating temperature range stored in a memory of the integrated circuit 56. In such examples, the integrated circuit 56 may electrically actuate the at least one heating element 68 to heat the ejection die 54 in response to determining that a temperature of the ejection die 54 is below the defined operating temperature range. Moreover, the integrated circuit 56 may stop electrical actuation of the at least one heating element 68 in response to determining that the temperature of the ejection die 54 is within or above the defined operating temperature range. In some examples, the at least one heating element 68 may be a resistive heating element.

In this example, the integrated circuit 56 comprises a controller 70 and a memory 72. As used herein, a controller may comprise a configuration of logical components for data processing. Examples of a controller include a central processing unit (CPU), a graphics processing unit (GPU), an application specific integrated circuit (ASIC), a microcontroller, and/or other such devices.

Memory, as used herein, may comprise various types of volatile and/or non-volatile memory. Memory, such as the memory 72 of the example device 50 may be a machine-readable storage medium. In some examples, the memory is non-transitory. Examples of memory include random access memory (RAM), read only memory (ROM) (e.g., Mask ROM, PROM, EPROM, EEPROM, etc.), flash memory, solid-state memory, magnetic disk memory, silicon-oxide-nitride-oxide-silicon (SONOS) memory, as well as other memory devices/modules that maintain stored information. In some examples, the controller 70 and memory 72 may be in a single package and may comprise a single integrated circuit. For example, an integrated circuit may comprise a microcontroller having a controller and memory in a single package.

As shown, the memory 72 of the example device 50 includes instructions 74 that may be executable by integrated circuit 56 (and/or the controller 70 thereof) to cause the integrated circuit 56 to perform operations described herein. For example, execution of the instructions 74 by the integrated circuit 56 may cause the integrated circuit 56 to control selective dispensation of printing material via ejection nozzles of the ejection die 54. As another example, execution of the instructions 74 by the integrated circuit 56 may cause the integrated circuit 56 to actuate the temperature sensor 66 to receive sensor data from the temperature sensor. Furthermore, execution of the instructions 74 by the integrated circuit 56 may cause the integrated circuit to control the at least one heating element 68.

Figure 3:
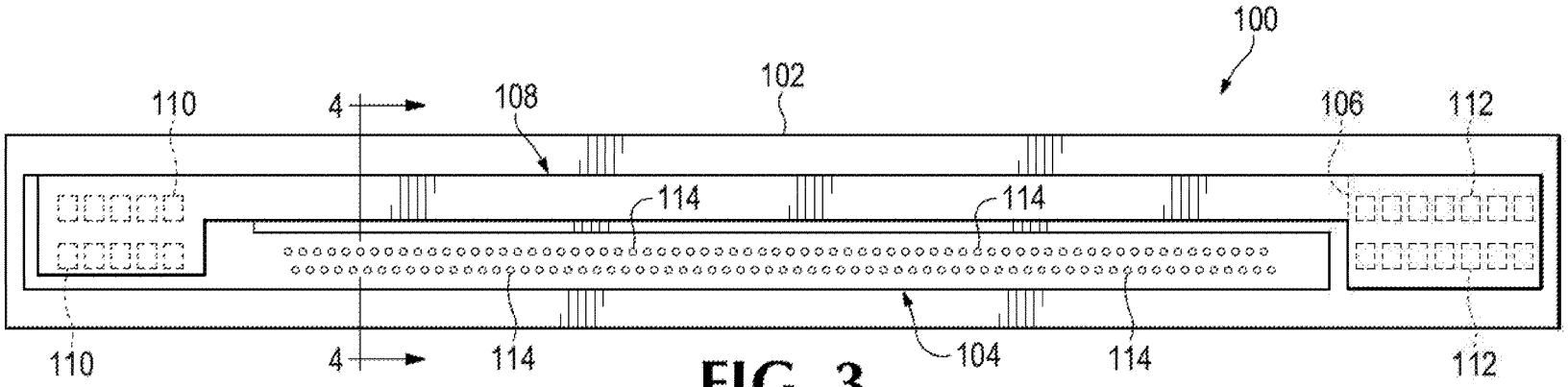
FIG. 3 is a block diagram of some components of an example fluid ejection device.

FIG. 3 is a top view that illustrates an example of some components of a fluid ejection device 100. In this example, the fluid ejection device 100 comprises a molded panel 102, an ejection die 104 molded in the molded panel 102, and an integrated circuit 106 molded in the molded panel 102. In this example, the ejection die 104 and the integrated circuit 106 are electrically connected via conducting elements disposed in a film that form a tape automated bond (TAB) element 108. As shown in this example, the TAB element 108 is positioned on a front surface of the fluid ejection device 100. In examples described herein, the front surface of the fluid ejection device 100 is composed of a front surface of the molded panel 102, a front surface of the ejection die 104, and a front surface of the integrated circuit 106. In examples, the front surface of the molded panel 102, the front surface of the ejection die 104, and the front surface of the integrated circuit 106 are approximately coplanar.

In this particular example, the TAB element 108 is at least partially positioned on the front surfaces of the ejection die 104 and the integrated circuit 106 at opposite ends of the molded panel 102. Furthermore, the TAB element 108 is electrically connected to electrical connection points 110 of the ejection die 104. The electrical connection points 110 of the ejection die 104 are illustrated in phantom to reflect that the electrical connection points 110 are covered by a portion of the TAB element 108. Similarly, the TAB element 108 is electrically connected to electrical connection points 112 of the integrated circuit 106. The electrical connection points 112 of the integrated circuit 106 are illustrated in phantom to reflect that that the electrical connection points 112 are covered by a portion of the TAB element 108. Electrical connection points, as used herein, may comprise bond pads or other such electrical terminals. As will be appreciated, electrical connection points may comprise copper and/or other conductive material.

While not shown in this example, the TAB element 108 may extend beyond the molded panel 102 such that the fluid ejection device 100 may be electrically connected to additional devices. For example, the TAB element 108 may extend beyond the molded panel 102 and connect the fluid ejection device 100 to a series of electrical contact points that in turn electrically connect to a controller of a printing device.

Furthermore, as shown in this example, the ejection die 104 comprises a plurality of ejection nozzles 114. The ejection nozzles 114 may be controlled to selectively dispense printing material. In this example, the electrical connection of the ejection die 104 and the integrated circuit 106 may facilitate control of the ejection nozzles 114 by the integrated circuit 106. For example, the integrated circuit 106 may comprise a controller to control the selective dispensation of printing material via the ejection nozzles 114.

Figure 4:
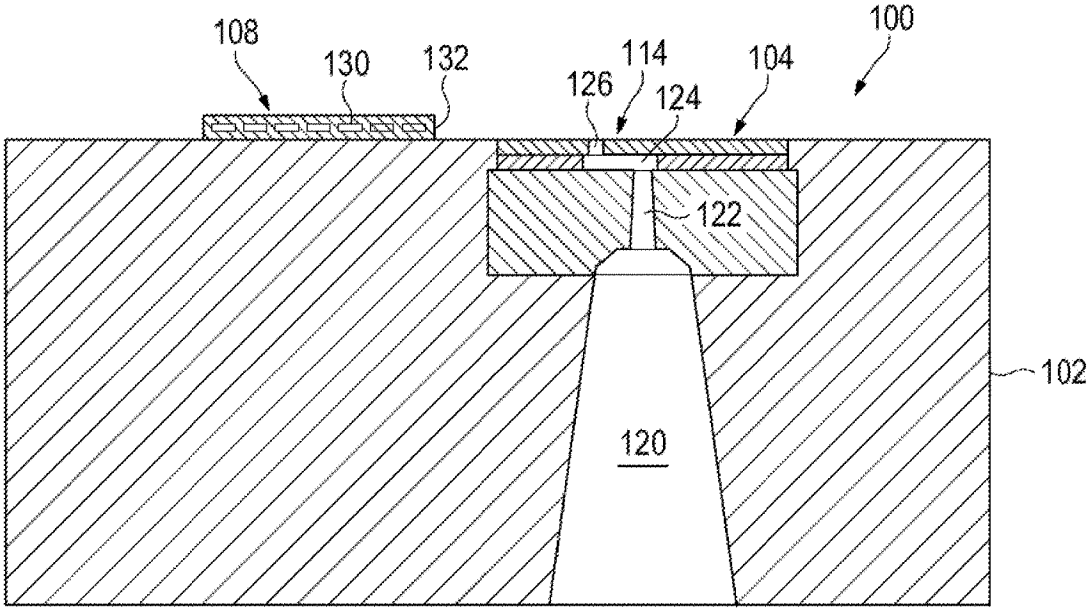
FIG. 4 is a cross-sectional view along view line 4-4 of FIG. 3 of the example fluid ejection device.

FIG. 4 provides a cross-sectional view of the example fluid ejection device 100 of FIG. 3 along the view line 4-4 of FIG. 4. As shown, the molded panel 102 includes a fluid communication channel 120 formed therethrough. The fluid communication channel 120 is in fluid communication with the ejection die 104 such that printing material may be conveyed to the ejection die 104 for selective dispensation thereby via the fluid communication channel 120. In this example, the cross-sectional view illustrates some components of the ejection die 104 and an ejection nozzle 114. The ejection die 104 has a fluid feed hole 122 formed in a back surface of the ejection die 104, where the fluid feed hole 122 is fluidly connected to the fluid communication channel 120 and an ejection chamber 124 of the ejection nozzle 114. The ejection chamber 124 is fluidly connected to a nozzle orifice 126 of the ejection nozzle 114. While not shown in this example, a fluid ejector of the ejection nozzle 114 may be positioned in the ejection chamber 124. Selective actuation of the fluid ejector may cause fluid in the ejection chamber 124 to be dispensed/ejected out of the orifice 126. As shown, an approximately planar front surface of the fluid ejection device 100 may be composed of a front surface of the molded panel 102 and an exposed front surface of the ejection die 104. The nozzle orifice 126 corresponds to an opening on the front surface of the ejection die 104, and the fluid communication channel 120 is formed in a back surface of the molded panel 102.

Furthermore, in this example, the cross-sectional view illustrates a cross-section of the TAB element 108. As shown, the TAB element 108 comprises electrical conducting elements 130 positioned on the front surface of the fluid ejection device 100. The electrical conducting elements 130 may be at least partially covered by an insulating film 132. Furthermore the electrical conducting elements 130 may be electrically connected to the integrated circuit 106 and the ejection die 104 in a tape automated bonding process. Accordingly, the TAB element 108 may be coupled to the front surface of the fluid ejection device 100 via an adhesive. As will be appreciated, during coupling of the TAB element 108 to the front surface of the fluid ejection device 100, the integrated circuit 106 and ejection die 104 are electrically connected via the TAB element 108.

Figure 5:
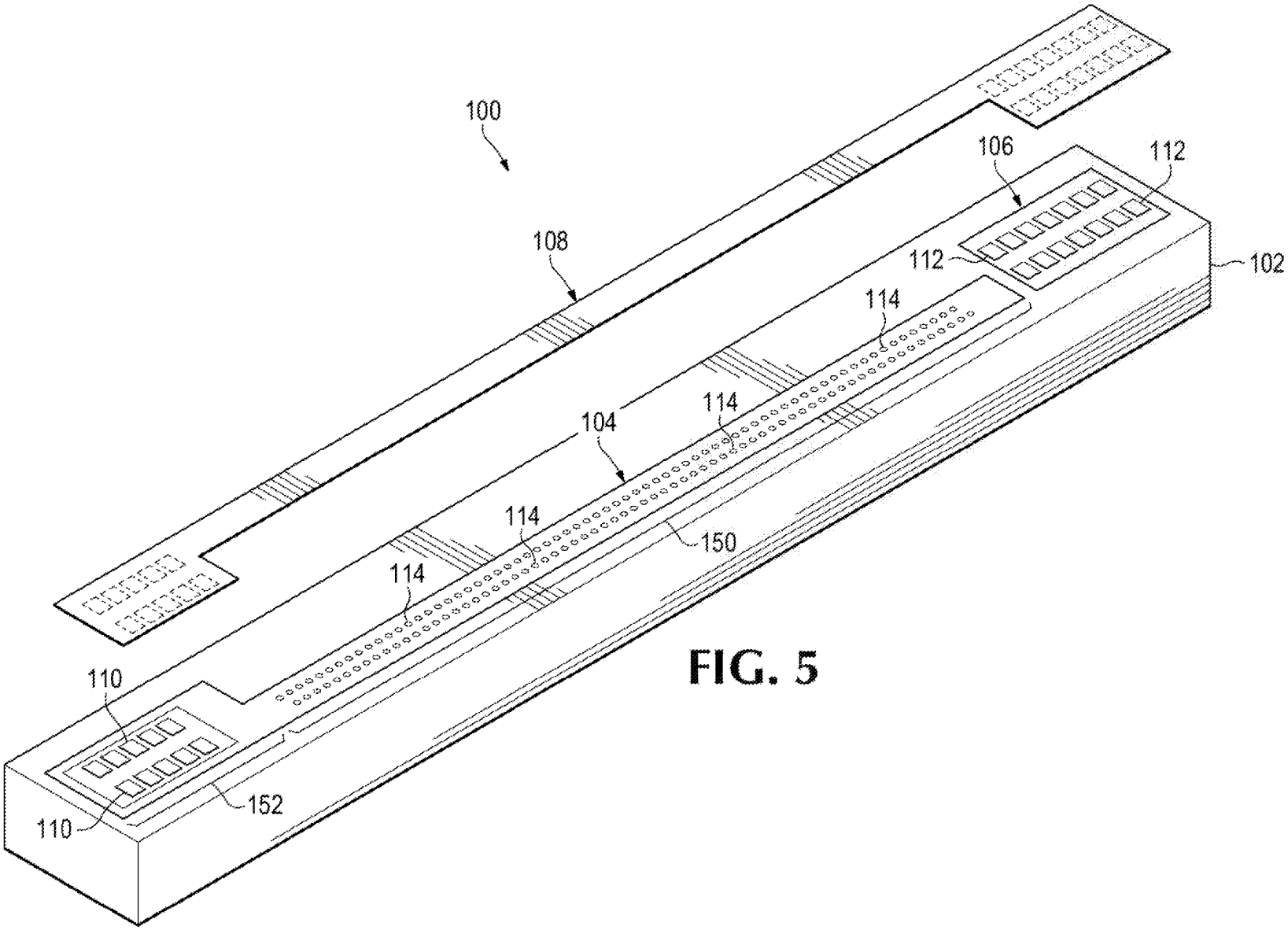
FIG. 5 is an isometric view of some components of an example fluid ejection device.

FIG. 5 is an exploded isometric view of the example fluid ejection device 100 of FIGS. 3 and 4. In this view, the TAB element 108 is spaced apart from the molded panel 102 to illustrate the underlying electrical connection points 110 of the ejection die 104 and the underlying electrical connection points 112 of the integrated circuit 106. As shown in FIG. 5, the ejection die 104 may be a non-rectangular shape. In this example, the ejection die 104 has a first elongated portion 150 along which ejection nozzles 114 may be arranged. In some examples, the length of the elongated portion may correspond to a printing width of the ejection die 104. Furthermore, the ejection die 104 has a second portion 152 in which the electrical contact points 110 of the ejection die 104 may be arranged. As shown, the second portion 152 of the ejection die 104 may be positioned at a first end of the fluid ejection device 100, and the integrated circuit 106 may be positioned at a second end of the fluid ejection device 100. The first elongated portion 150 of the ejection die 104 may be arranged between the integrated circuit 106 and the second portion 152.

Figure 6A:
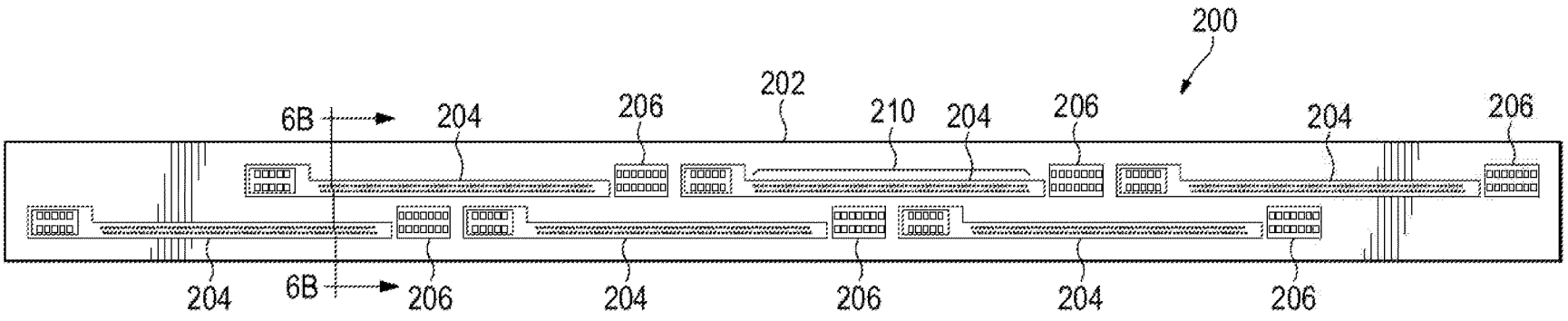
FIG. 6A is a block diagram of an example fluid ejection device.

FIG. 6A is a block diagram that illustrates some components of an example fluid ejection device 200. The fluid ejection device 200 comprises a molded panel 202, a plurality of ejection dies 204 molded into the molded panel 202, and a plurality of integrated circuits 206 molded into the molded panel 202. As shown in this example, the ejection dies 204 may be arranged generally end-to-end along a width of the fluid ejection device 200 (and a width of the molded panel 202). Furthermore, the ejection dies 204 may be arranged in a staggered/overlapping relationship.

In examples similar to the example of FIG. 6A, the width of the fluid ejection device 200 along which the ejection dies 204 may be arranged may correspond to a printing width of a printing system in which the fluid ejection device may be implemented. In some examples, the fluid ejection device 200 may be implemented in a page-wide printing system. In these examples, the fluid ejection device 200 may facilitate a printing width that corresponds to a width of a media upon which printing material is to be selectively dispensed. In other examples, a plurality of fluid ejection devices similar to the illustrated example may be arranged in a staggered/overlapping end-to-end arrangement that corresponds to a printing width for a printing system. Each ejection die 204 comprises a plurality of ejection nozzles 210 by which to selectively dispense printing material. In this example, the ejection nozzles 210 may be arranged in a staggered arrangement along a length of an elongated portion of each ejection die 204.

For each respective ejection die 204 of the plurality, the fluid ejection device 200 includes a respective integrated circuit 206 molded into the molded panel 200 proximate the ejection die 204. As discussed with regard to other examples, each respective ejection die 204 may be electrically connected to the respective integrated circuit 206, and the respective integrated circuit may control selective dispensation of printing material by the respective ejection die 204. While in the examples shown herein, example fluid ejection devices comprise an integrated circuit for each ejection die, it will be appreciated that other examples may have less integrated circuits than ejection dies or more integrated circuits than ejection dies. As a particular example, a fluid ejection device may comprise one integrated circuit that is electrically connected to at least two ejection dies, and the integrated circuit may control selective dispensation of printing material by the at least two ejection dies.

Figure 6B:
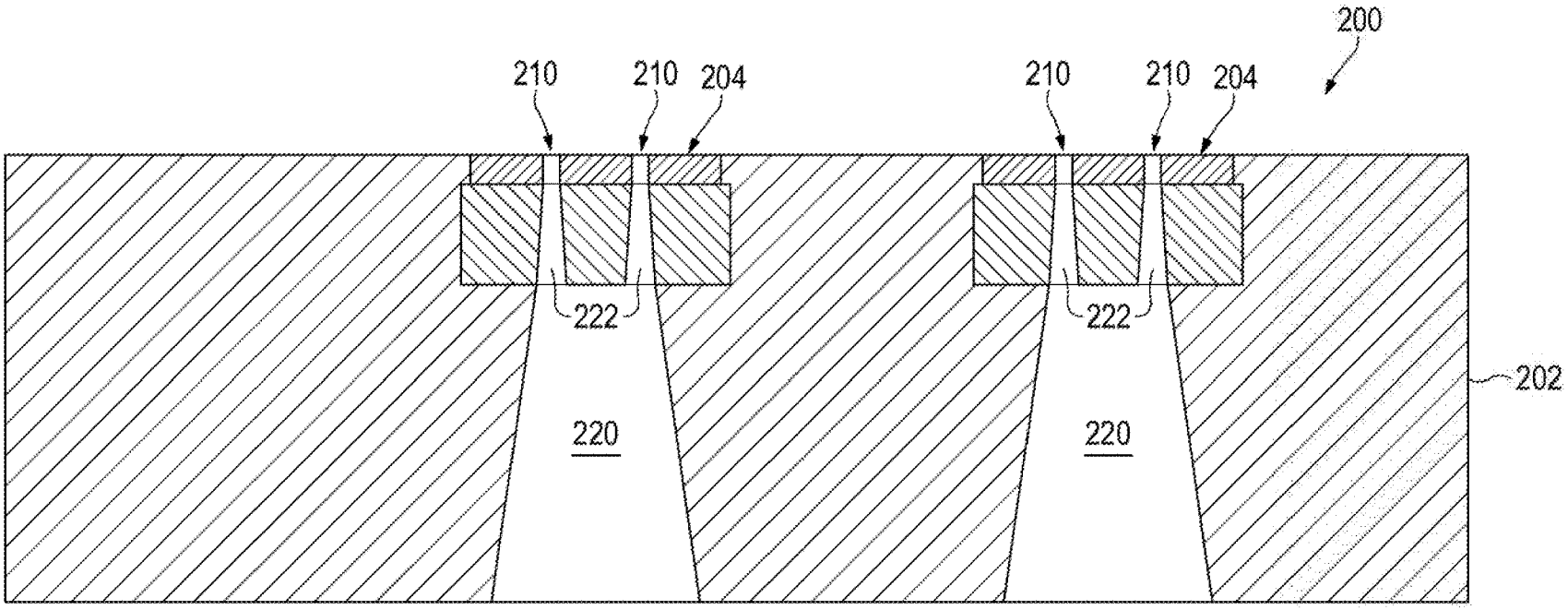
FIG. 6B is a cross-sectional view along view line 6B-6B of FIG. 6A of the example fluid ejection device.

FIG. 6B is a cross-sectional view along the view line 6B-6B of the example fluid ejection device 200 of FIG. 6A. As shown in this example, the molded panel 202 has a respective fluid communication channel 220 for each respective ejection die 204. The respective fluid communication channel 220 is fluidly connected to the respective ejection die 204 such that printing material to be selectively dispensed by the respective ejection die 204 may be conveyed from a printing material reservoir via the respective fluid communication channel to the ejection die 204. Each fluid communication channel 220 is formed through a back surface of the molded panel 202. Each ejection die 204 may have a fluid feed hole 222 that fluidly connects the respective fluid communication channel 220 to an ejection nozzle 210. As shown by the cross-sectional view, the ejection dies 204 may be at least partially embedded in the molded panel 202 such that a front surface of each ejection die 204 is exposed, sides of the ejection die 204 are encased in material of the molded panel, and at least a portion of a back surface of the ejection die 204 is encased in material of the molded panel.

Figure 7:
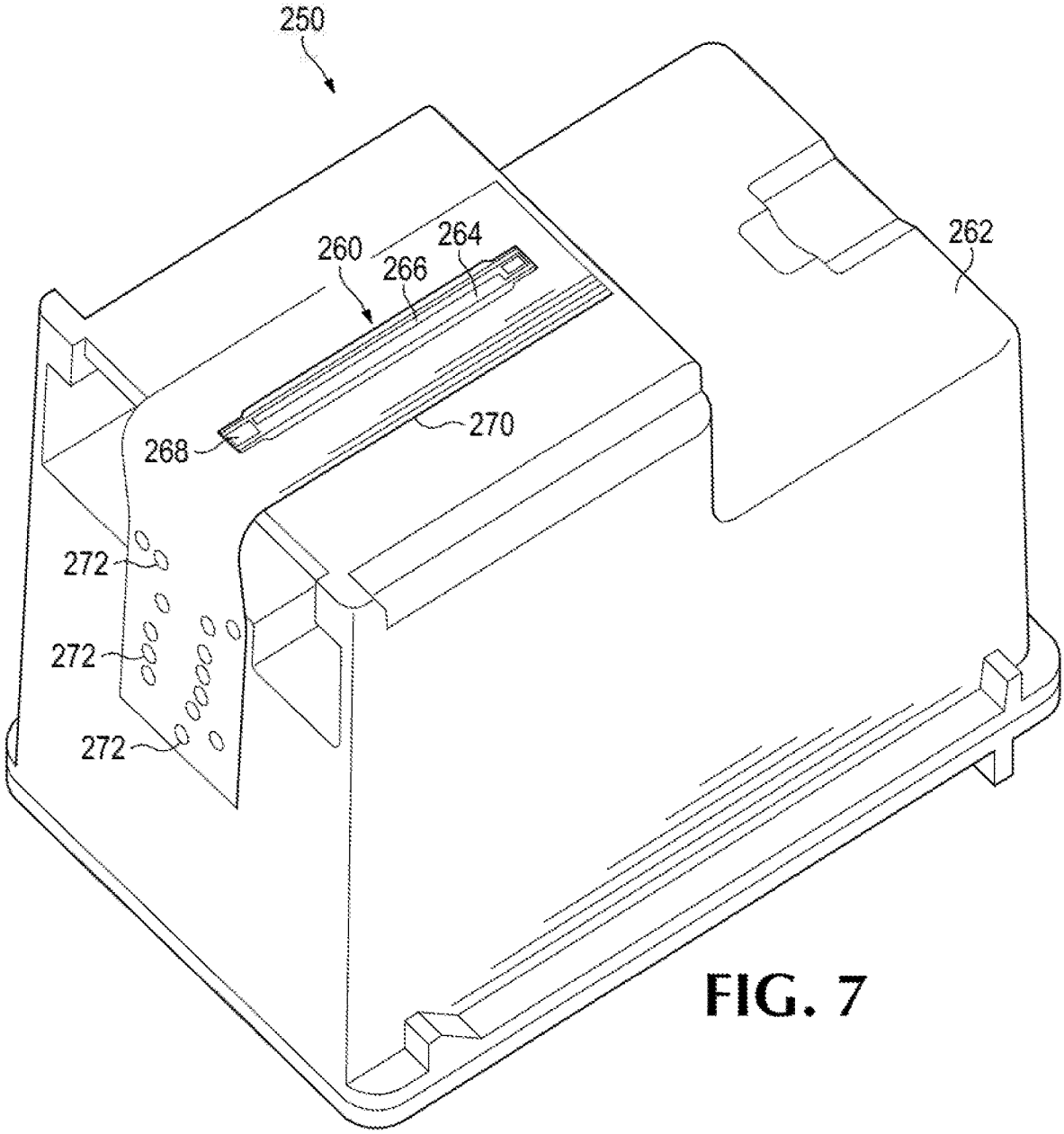
FIG. 7 is an isometric view of an example printing fluid cartridge comprising an example fluid ejection device.

FIG. 7 provides an isometric view of some components of an example printing fluid cartridge 250 that comprises an example fluid ejection device 260 coupled to a container 262 that may contain printing material. The fluid ejection device 260 comprises a molded panel 264, an ejection die 266 molded into the molded panel 264, and an integrated circuit 268 molded into the molded panel. As will be appreciated, the fluid ejection device 260 comprises features and components similar to the other fluid ejection devices 260 described herein, including a fluid communication channel, ejection nozzles, electrical contact points, and electrical conducting elements. Moreover, the integrated circuit 268 may control selective dispensation of printing material by the ejection die 204 as described herein. In examples such as the example printing fluid cartridge 250, the fluid communication channel may fluidly connect the container 262 and the ejection die 266 such that printing material stored in the container 262 may be conveyed to the ejection die 266 for selective dispensation thereby.

In this example, the fluid ejection device 260 is electrically connected to a flexible circuit 270, where the flexible circuit 270 may comprise electrical conducting elements. In some examples, the flexible circuit 270 may electrically connect the ejection die 266 and the integrated circuit 268. In addition, as shown, the flexible circuit 270 comprises electrical contact points 272 that may facilitate electrical connection of the fluid ejection device 260 and the printing fluid cartridge 250 to an external device, such as a printing device.

In such examples, an externally connected device may be electrically connected to the fluid ejection device 260 such that the external device may communicate nozzle data to the integrated circuit 268. In such examples, the integrated circuit may receive nozzle data, and the integrated circuit may control selective dispensation of printing material with ejection nozzles based at least in part on the nozzle data.

However, in some examples, received nozzle data may not correspond to the arrangement of ejection nozzles of the fluid ejection device 260. For example, the integrated circuit may facilitate printing with a printing fluid cartridge having a fluid ejection device similar to the examples provided herein in a legacy printing system, where such functionality may be referred to as backwards compatibility. In such examples, nozzle data received at the integrated circuit may be translated to updated nozzle data, where the updated nozzle data corresponds to an arrangement of ejection nozzles of the ejection die to which the integrated circuit is electrically connected.

Figure 8:
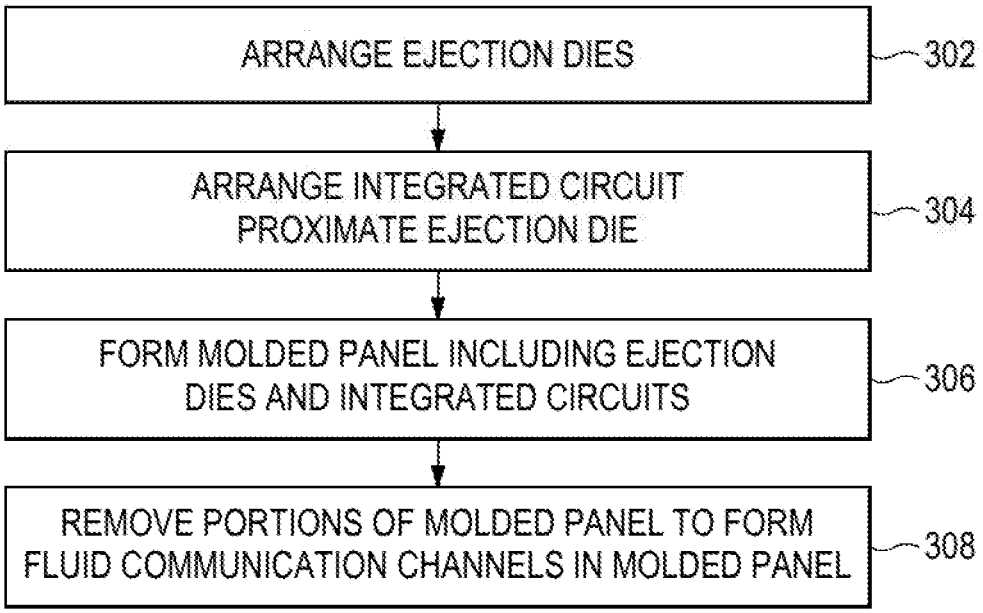
FIG. 8 is a flowchart of an example process.

FIG. 8 provides a flowchart that illustrates an example process 300 that may be performed to form an example device as described herein. Ejection dies are arranged for fabrication of fluid ejection devices (block 302). A respective integrated circuit is arranged proximate a respective ejection die (block 304). A molded panel is formed such that the molded panel includes the ejection dies and integrated circuits molded into the molded panel (block 306). Portions of the molded panel are removed to thereby form a respective fluid communication channel for each ejection die (block 308).

Figure 9:
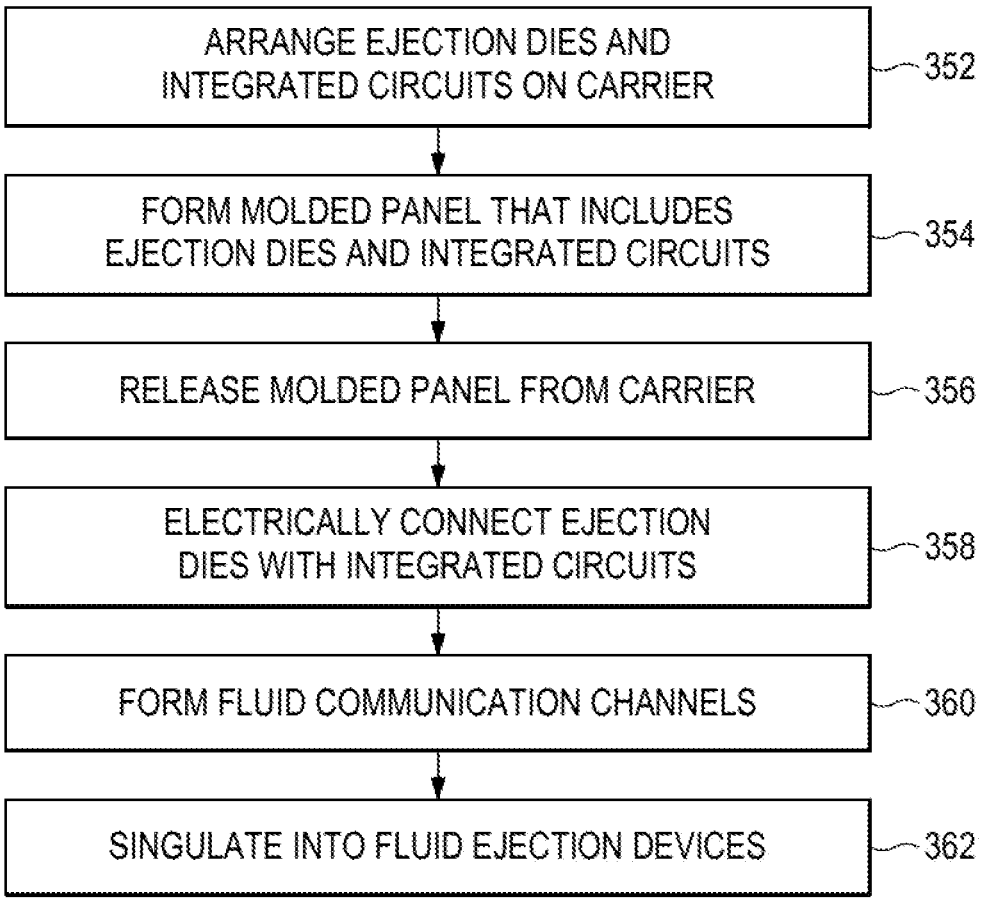
FIG. 9 is a flowchart of an example process.

FIG. 9 provides a flowchart that illustrates an example process 350 that may be performed to form an example device as described herein. In this example, ejection dies and integrated circuits may be arranged on a carrier (block 352). In some examples, a front surface of each ejection die and each integrated circuit may be removably coupled to the carrier with an adhesive. For example, the adhesive may be a thermal release tape. A molded panel may be formed that includes the ejection dies and the integrated circuits molded into the molded panel (block 354). In some examples, forming the molded panel comprises depositing a mold material over the integrated circuits and ejection dies on the carrier and molding the mold material. For example, mold material may be compression molded to form a molded panel. Other types of exposed die molding may be performed, such as transfer molding.

After forming the molded panel, the molded panel is released from the carrier (block 356). As discussed, in some examples, the integrated circuits and ejection dies may be removably coupled to the carrier upon which they are arranged with a releasable adhesive, such as thermal release tape. In such examples, the adhesive that couples the integrated circuits and ejection dies to the carrier is released. A respective ejection die may be electrically connected with a respective integrated circuit (block 358). In some examples, an ejection die and an integrated circuit may be electrically connected with a wire bonding process. In other examples, an ejection die and an integrated circuit may be electrically connected with a tape automated bonding process.

After releasing the molded panel from the carrier, a respective fluid communication channel may be formed for each respective ejection die (block 360). In examples provided herein, forming a fluid communication channel may comprise removing a portion of the molded panel. Examples may slot-plunge cut a back surface of the molded panel. In other examples, removing a portion of the molded panel may comprise cutting the molded panel with a laser or other cutting device. Furthermore, removing a portion of the molded panel may comprise performing other micromachining processes (e.g., ultrasonic cutting, powder blasting, etc.). After forming fluid communication channels, the molded panel may be singulated into fluid ejection devices, such as the example fluid ejection devices described herein. In some examples, singulating the molded panel may comprise dicing the molded panel, cutting the molded panel, and/or other such known singulation processes.

Figure 10:
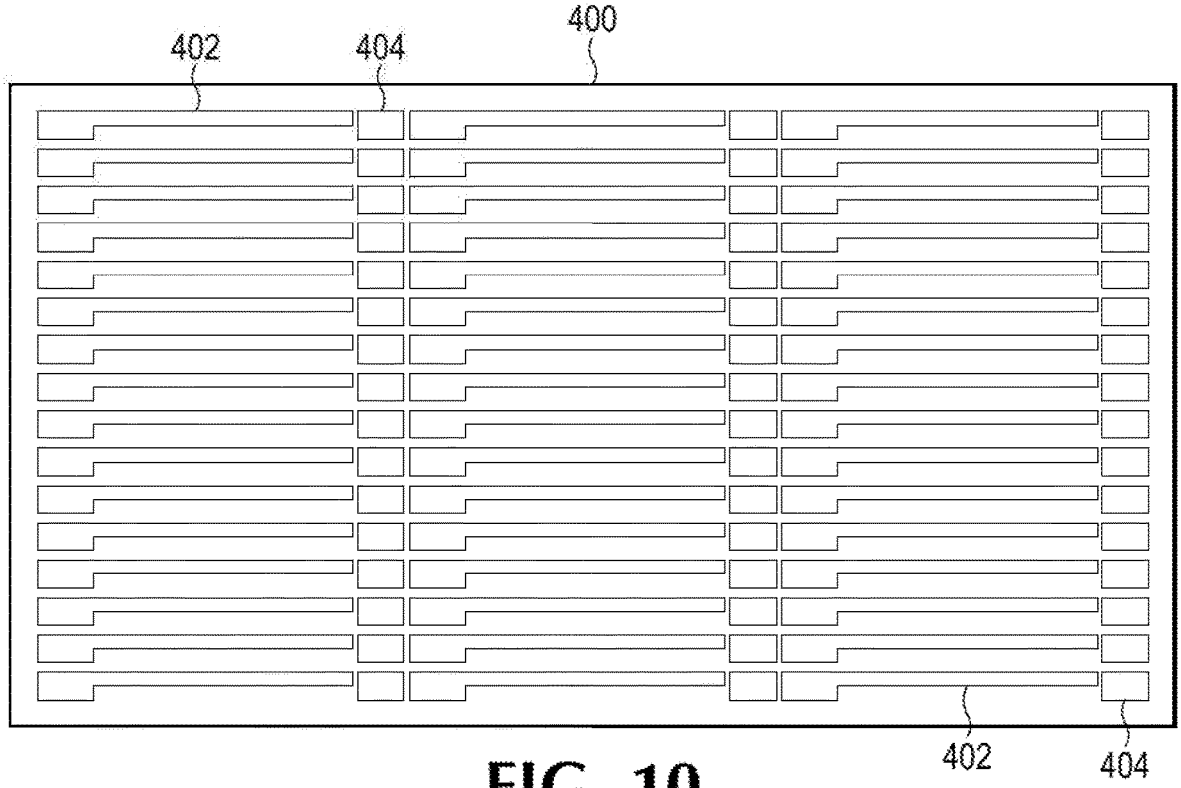
FIGS. 10-14B are block diagrams that illustrate example operations of the example processes of FIGS. 9 and 10.

FIGS. 10-14B provide example block diagrams that illustrate examples corresponding to operations of the processes of FIGS. 8 and 9. FIG. 10 illustrates a carrier 400, ejection dies 402 arranged on the carrier, and integrated circuits 404 arranged on the carrier. In this example, front surfaces of the ejection dies 404 and the integrated circuits 406 are arranged on the carrier 400 such that back surfaces of the ejection dies 404 and the integrated circuits 406 are upright in this view. In FIG. 11A, a mold material has been deposited on the carrier 400 and the mold material has been molded to thereby form a molded panel 420 that includes the ejection dies 402 and integrated circuits 404.

Figure 11A:
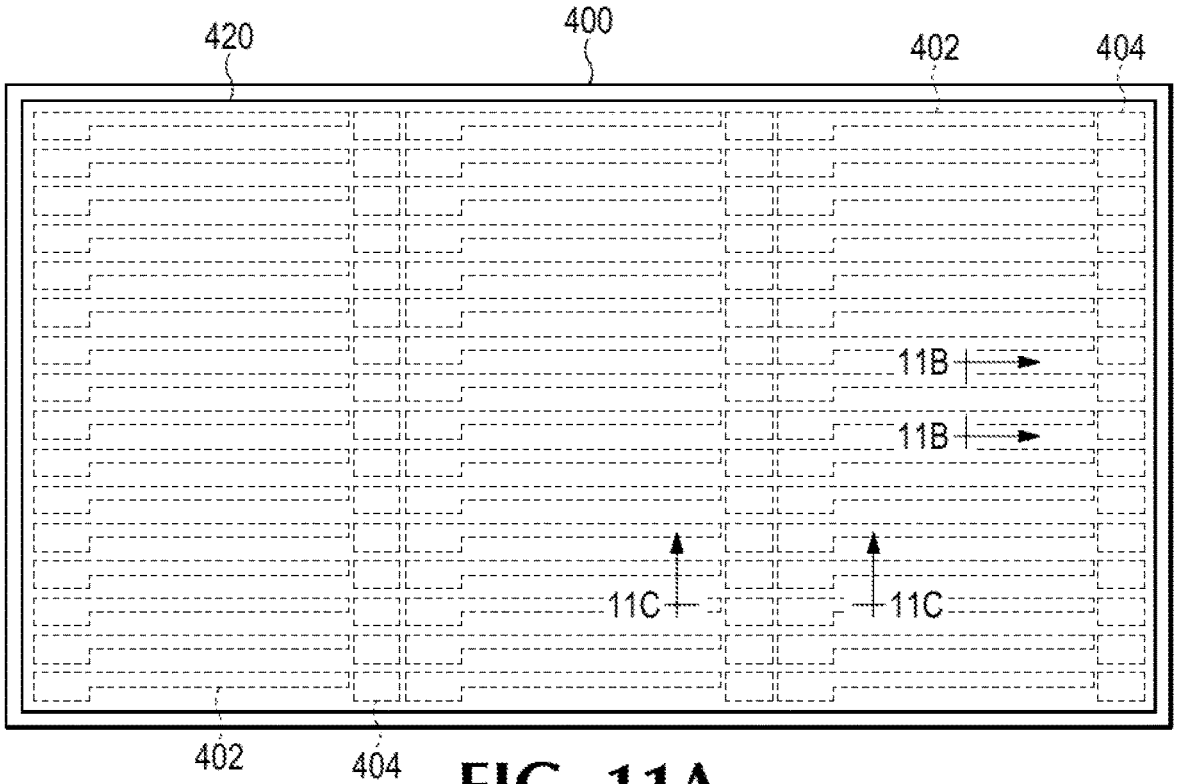
Figure 11B:
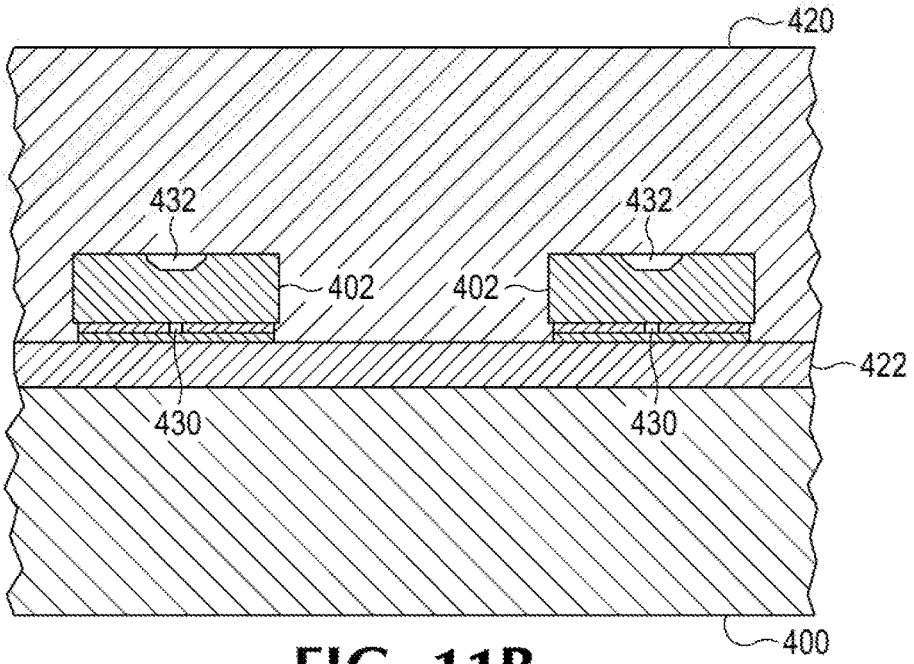
Figure 11C:
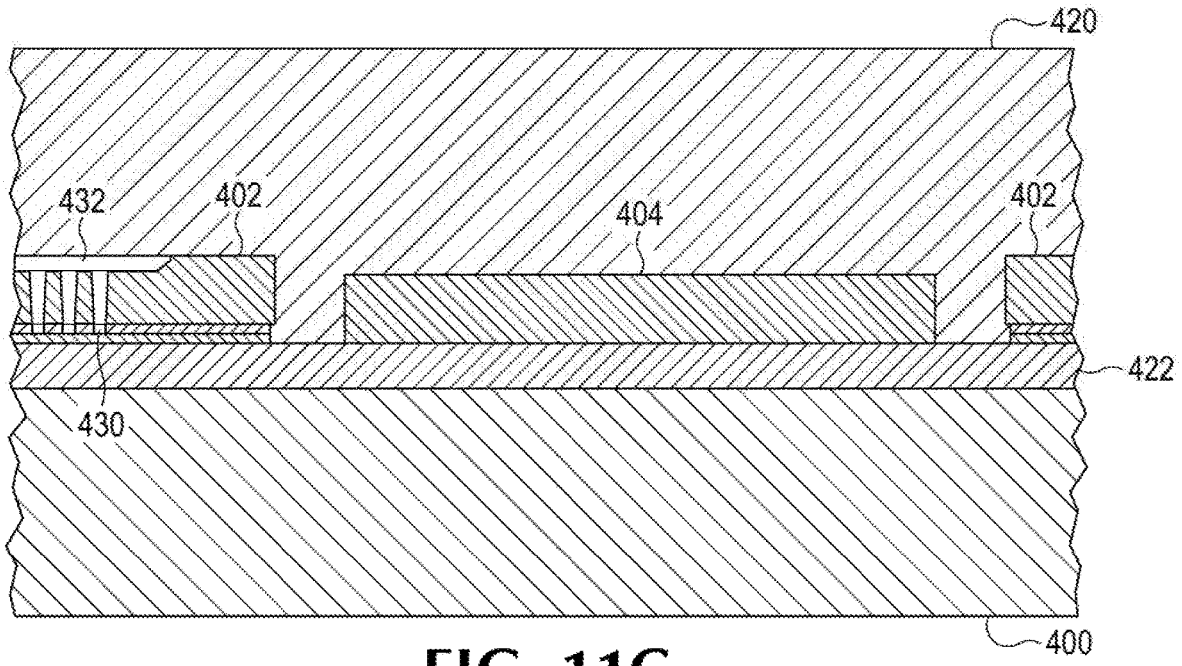

FIG. 11B is a cross-sectional view of the example of FIG. 11A along view line 11B-11B. As shown in FIG. 11B, the carrier 400 is coupled to the ejection dies 402 via a releasable adhesive 422. Furthermore, as described previously, a front surface of the each ejection die 402 upon which a nozzle orifice 430 is formed is coupled to the carrier 400 via the releasable adhesive 422. A back surface of each ejection die 402 has a fluid feed hole 432 formed therein. However, during the fabrication process, the fluid feed hole 432 may be filled with a protective material to prevent mold material from being deposited in the fluid feed hole 432. FIG. 11C is a cross-sectional view of the example of FIG. 11A along view line 11C-11C. As shown in FIGS. 11B and 11C, the molded panel 420 partially encloses the ejection dies 402 and the integrated circuits 404. In particular, at this stage of example processes, the back surfaces and sides of the ejection dies 402 and integrated circuits 404 are covered by mold material of the molded panel 420.

Figure 12A:
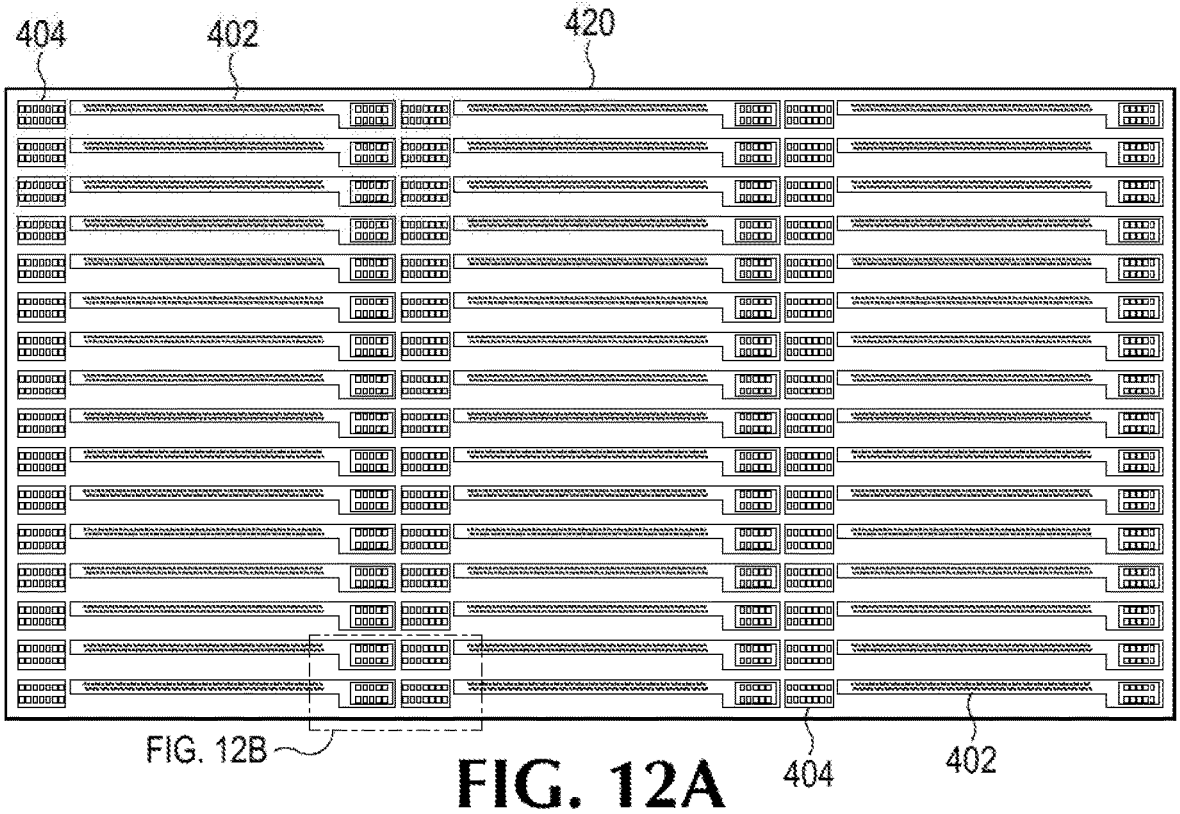
Figure 12B:
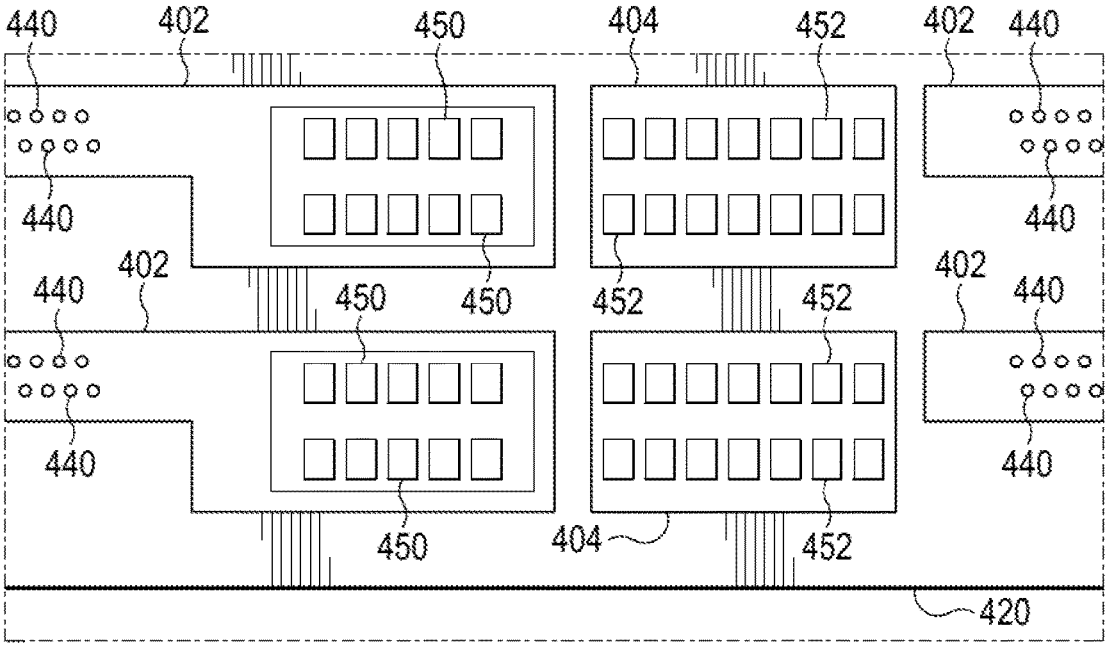

In FIG. 12A, the molded panel 420 has been released from the carrier such that the front surfaces of the ejection dies 402 and the integrated circuits 404 are exposed. FIG. 12B is a detail view of the example of FIG. 12A. As shown in FIG. 12B, the front surfaces of the ejection dies 402 and integrated circuits 404 are exposed such that ejection nozzles 440 of the ejection dies 402 are exposed. In addition, electrical contact points 450 of the ejection dies 402 and electrical contact points 452 of the integrated circuits are exposed. As shown, front surfaces of the ejection dies 402, integrated circuits 404, and the molded panel 420 are approximately planar.

Figure 13A:
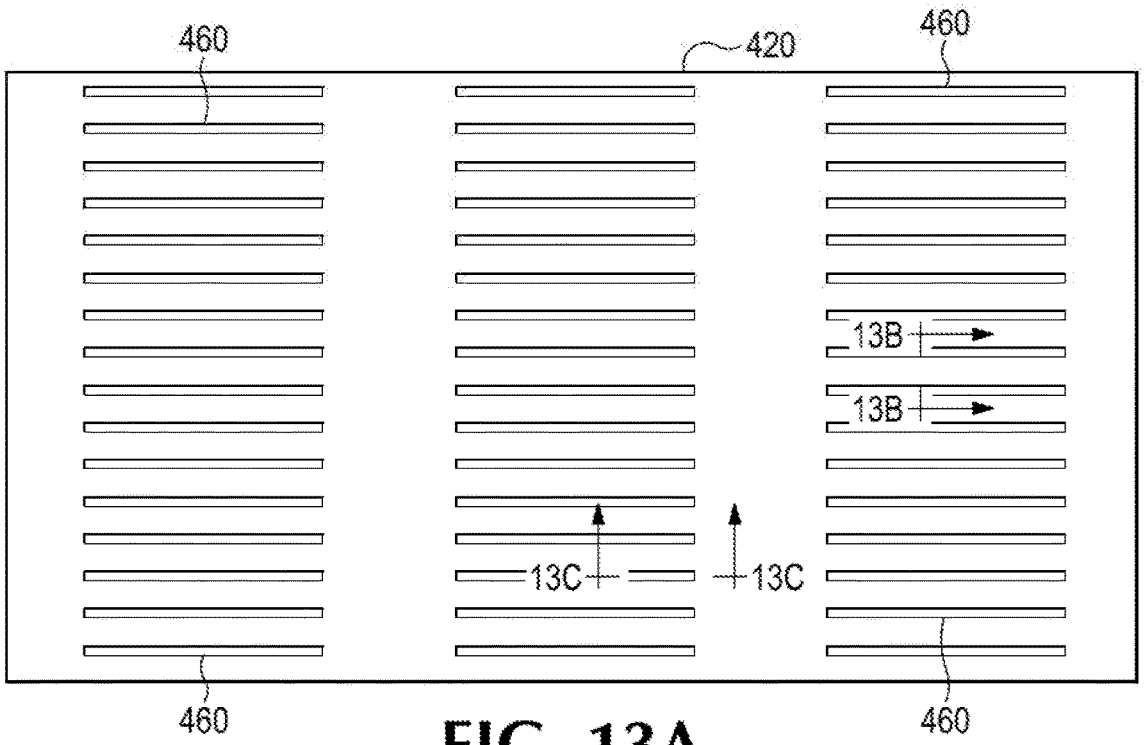
Figure 13B:
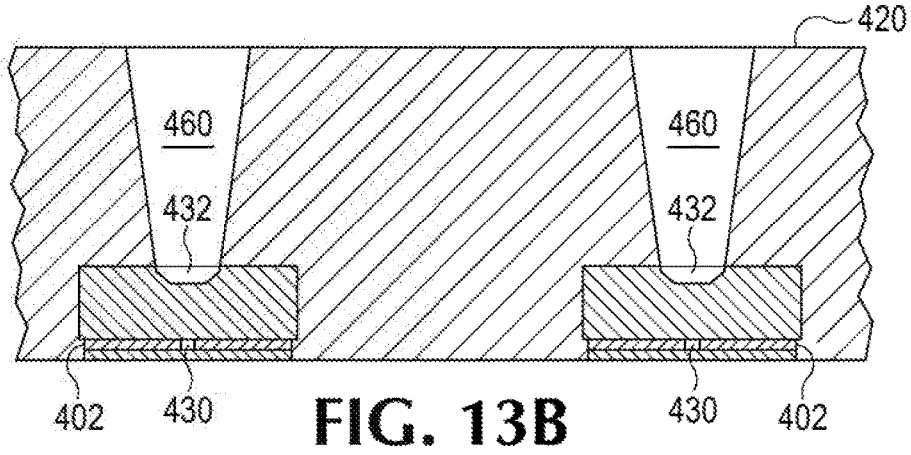
Figure 13C:
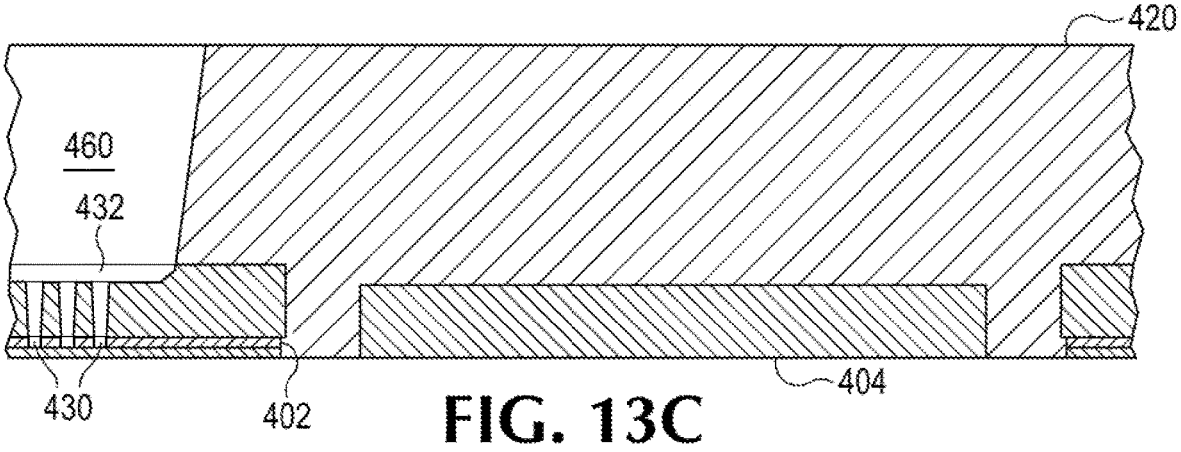

In FIG. 13A fluid communication channels 460 have been formed in a back surface of the molded panel 420. As will be appreciated, FIGS. 12A-B show a front surface of the molded panel 420, and FIG. 13 illustrates an opposite back surface. FIG. 13B provides a cross-sectional view of the example of FIG. 13A along view line 13B-13B. As shown, each fluid communication channel 460 is fluidly connected to a respective ejection die 402. In particular, the fluid communication channel 460 may fluidly connect to the fluid feed hole 432 of each ejection die 402. FIG. 13C provides a cross-sectional view of the example of FIG. 13A along view line 13C-13C.

Figure 14A:
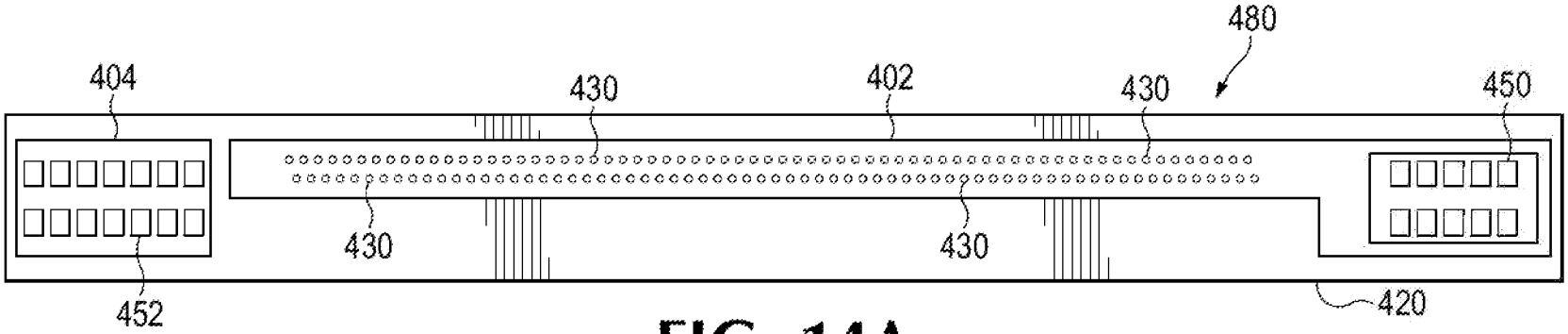
Figure 14B:
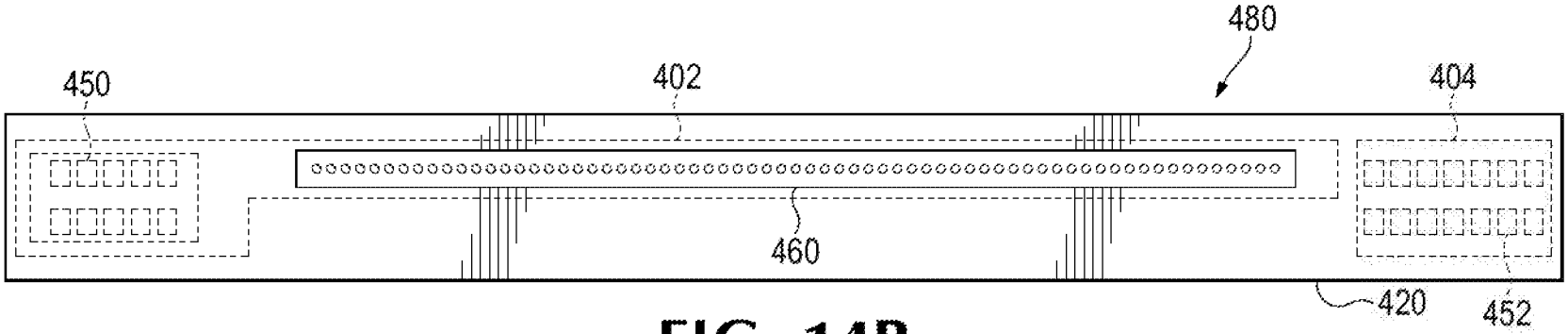

FIGS. 14A-B illustrate an example singulated fluid ejection device 480 that may be formed by singulation of the example of FIG. 13A. FIG. 14A illustrates a front surface of the example fluid ejection device 480 and FIG. 14B illustrates a back surface of the example fluid ejection device 480. In FIG. 14A, the front surface of the example fluid ejection device 480 corresponds to a front surface of an ejection die 402 and integrated circuit 404, such that ejection nozzles 430 and electrical contact points 450, 452 are exposed (i.e., not covered by mold material of the molded panel 420). In FIG. 14B, the ejection die 402, integrated circuit 404, and electrical contact points 450, 452 are illustrated in phantom to illustrate positioning thereof relative to the fluid communication channel 460 formed in the back surface of the molded panel 420.

Figure 15:
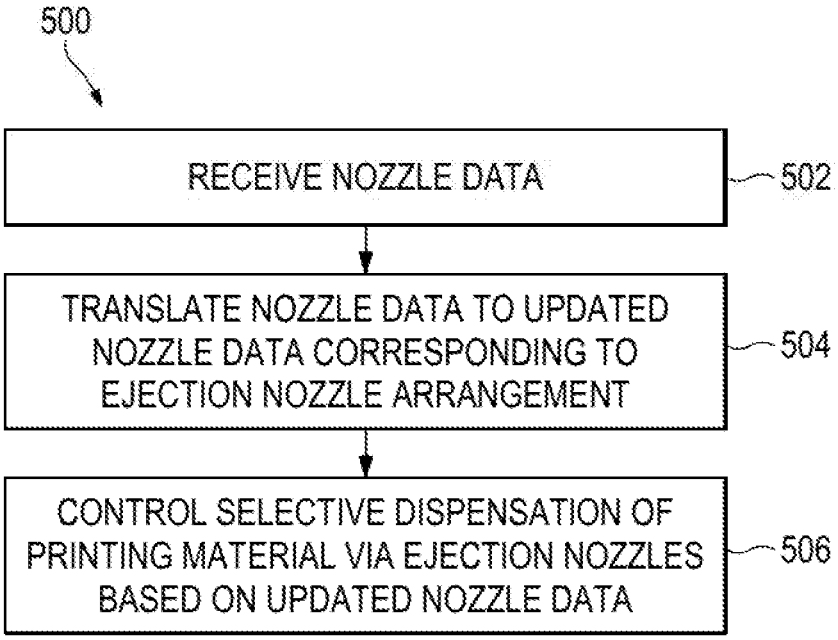
FIG. 15 is a flowchart that illustrates a sequence of operations that may be performed by an integrated circuit of an example fluid ejection device.
Figure 16:
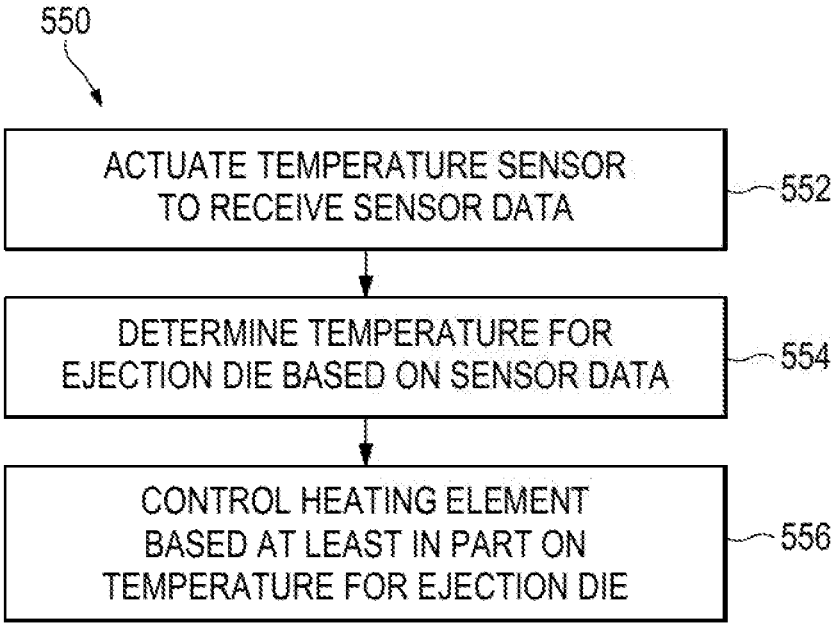
FIG. 16 is a flowchart that illustrates a sequence of operations that may be performed by an integrated circuit of an example fluid ejection device.

FIGS. 15 and 16 are flowcharts that provide example sequences of operations that may be performed by an integrated circuit of an example fluid ejection device to perform example processes and methods. In some examples, the operations included in the flowcharts may be embodied in a memory resource (such as the example memory 72 of FIG. 2) in the form of instructions that may be executable by an integrated circuit to cause the integrated circuit to perform the operations corresponding to the instructions.

As shown in the flowchart 500 of FIG. 15, an integrated circuit of an example fluid ejection device may receive nozzle data (block 502). The integrated circuit may translate the received nozzle data to updated nozzle data corresponding to an arrangement of ejection nozzles of an ejection die of the fluid ejection device (block 504). The integrated circuit may control selective dispensation of printing material via the ejection nozzles based at least in part on the updated nozzle data (block 506). Accordingly, in examples similar to the example provided in FIG. 15, some examples may facilitate backwards compatibility of example fluid ejection devices described herein in printing systems that send nozzle data not formatted for an arrangement of ejection nozzles of the example fluid ejection devices.

For the flowchart 550 of FIG. 16, an integrated circuit of an example fluid ejection device may actuate a temperature sensor of an ejection die to receive sensor data from the temperature sensor (block 552). The integrated circuit may determine a temperature for the ejection die based on the sensor data (block 554), and the integrated circuit may control a heating element of the ejection die based at least in part on the temperature for the ejection die (block 556).

Accordingly, examples provided herein may provide fluid ejection devices including a molded panel having integrated circuits and ejection dies molded therein. In addition, examples may include non-rectangular dies that may reduce electrical connection complexity. Furthermore, examples may facilitate backwards compatibility of example fluid ejection devices in some legacy printing systems. In addition, in some examples, localizing control operations for an ejection die on a proximate integrated circuit may reduce fabrication complexity with regard to ejection dies.

The preceding description has been presented to illustrate and describe examples of the principles described. This description is not intended to be exhaustive or to limit these principles to any precise form disclosed. Many modifications and variations are possible in light of the description. Therefore, the foregoing examples provided in the figures and described herein should not be construed as limiting of the scope of the disclosure, which is defined in the Claims.

The invention claimed is:

1. A fluid ejection device comprising:

a molded panel having a fluid communication channel formed therethrough;

at least one ejection die molded to the molded panel, the at least one ejection die comprising a plurality of ejection nozzles that are fluidly connected to the fluid communication channel, each ejection nozzle to selectively dispense printing material received from the fluid communication channel; and an integrated circuit molded into the panel and electrically connected to the ejection die, the integrated circuit to: receive nozzle data and control selective dispensation of printing material via the plurality of ejection nozzles based at least in part on the nozzle data.

2. The fluid ejection device of claim 1, wherein the at least one ejection die comprises a temperature sensor and at least one heating element, and the integrated circuit is further to receive sensor data from the temperature sensor and control the at least one heating element of the at least one ejection die based at least in part on the sensor data.

3. The fluid ejection device of claim 1, wherein the integrated circuit and the at least one fluid ejection die are electrically connected in a tape automated bonding process.

4. The fluid ejection device of claim 1, wherein the integrated circuit translates the received nozzle data to updated nozzle data that corresponds to an arrangement of the plurality of ejection nozzles of the at least one ejection die, and the integrated circuit controls the selective dispensation of printing material via the plurality of ejection nozzles based at least in part on the updated nozzle data.

5. The fluid ejection device of claim 1, wherein the ejection die further comprises a plurality of electrical connection points electrically connected to the ejection nozzles, the ejection die has an elongated portion along which the plurality of ejection nozzles are arranged, and the ejection die has a connection portion in which the plurality of electrical connection points are arranged.

6. The fluid ejection device of claim 5, wherein the elongated portion of the ejection die has a length to width ratio of at least 50, and a width of the connection portion of the ejection die is approximately 2 times a width of the elongated portion.

7. The fluid ejection device of claim 1, wherein the fluid ejection device has a front surface, and the plurality of ejection nozzles are exposed along the front surface, wherein the ejection die has a first end and a second end that is opposite the first end, the ejection die comprises a first set of electrical connection points positioned at the first end of the ejection die and electrically connected to the ejection nozzles, wherein the integrated circuit die is arranged in the molded panel proximate the second end of the ejection die, and the integrated circuit die comprises a second set of electrical connection points, and wherein the ejection device further comprises electrical conducting elements positioned on the front surface of fluid ejection device that electrically connect the first set of electrical connection points and the second set of electrical connection points.

8. The fluid ejection device of claim 1, wherein the at least one ejection die comprises a plurality of ejection dies, the fluid ejection device comprises a respective integrated circuit for each respective ejection die of the plurality, and the molded panel has a respective fluid communication channel formed therein for each respective ejection device of the plurality, wherein the molded panel has a width that corresponds to a page-wide printing width, the plurality of ejection dies are arranged generally end-to-end along the width of the molded panel, and the respective integrated circuit for each respective ejection die is positioned proximate the respective ejection die along the width of the molded panel.

9. A process comprising:

arranging a plurality of ejection dies, each ejection die comprising a plurality of ejection nozzles;

arranging a respective integrated circuit proximate each respective ejection die of the plurality, the respective integrated circuit to control selective dispensation of printing material via the ejection nozzles of the respective ejection die;

forming a molded panel including the plurality of ejection dies and the respective integrated circuits;

electrically connecting each respective election die to the respective integrated circuit with electrical conducting elements on a front surface of the molded panel; and removing portions of the molded panel to thereby form a respective fluid communication channel for each respective ejection die of the plurality, each respective fluid communication channel being thereby fluidly connected to the ejection nozzles of the respective ejection die.

10. The process of claim 9, wherein electrically connecting each respective ejection die to the respective integrated circuit comprises tape automated bonding each respective ejection die to the respective integrated circuit.

11. The process of claim 9, wherein removing portions of the molded panel comprises slot cutting a back surface of the molded panel.

12. The process of claim 9, further comprising:

singulating the molded panel into respective fluid ejection devices that each comprise at least one ejection die of the plurality and a respective integrated circuit associated with the least one ejection die.

13. A printing fluid cartridge comprising:

a container to contain printing material; and a fluid ejection device coupled to the container, the fluid ejection device comprising:

a molded panel having a fluid communication channel formed therein, the fluid communication channel fluidly connected to the container;

an ejection die molded into the molded panel, the ejection die comprising a plurality of ejection nozzles, the ejection nozzles fluidly connected to the fluid communication channel, and the ejection nozzles to selectively dispense printing material received from the container via the fluid communication channel; and an integrated circuit molded into the panel and electrically connected to the ejection nozzles, the integrated circuit to control selective dispensation of printing material via the plurality of ejection nozzles.

14. The printing fluid cartridge of claim 13, wherein the integrated circuit is further to: receive nozzle data;

translate the received nozzle data to updated nozzle data that corresponds to an arrangement of the ejection nozzles of the ejection die, wherein the integrated circuit controls selective dispensation of printing material via the plurality of ejection nozzles based at least in part on the updated nozzle data.

* * * * *